US007967589B2

(12) United States Patent
Liu

(10) Patent No.: US 7,967,589 B2
(45) Date of Patent: Jun. 28, 2011

(54) MOLD FOR MAKING CERAMICS

(76) Inventor: Te-En Liu, Taichung (TW)

( * ) Notice: Subject to any disclaimer, the term of this patent is extended or adjusted under 35 U.S.C. 154(b) by 267 days.

(21) Appl. No.: 12/286,665

(22) Filed: Oct. 1, 2008

(65) Prior Publication Data

US 2010/0009021 A1 Jan. 14, 2010

(51) Int. Cl.
*B29C 43/32* (2006.01)

(52) U.S. Cl. ..... 425/84; 425/412; 425/414; 249/112; 249/134

(58) Field of Classification Search ..... 425/84–86, 425/412–414; 249/112–113, 134, 141
See application file for complete search history.

(56) References Cited

U.S. PATENT DOCUMENTS 3,641,229 A * 2/1972 Lawrence et al. ..... 249/66.1
6,248,271 B1 * 6/2001 Graham et al. ..... 249/112
6,805,191 B2 * 10/2004 Ban et al. ..... 164/359
6,866,803 B1 * 3/2005 Matsumoto et al. ..... 264/42

* cited by examiner

*Primary Examiner* — Richard Crispino
*Assistant Examiner* — Thu Khanh T Nguyen
(74) *Attorney, Agent, or Firm* — McCracken & Frank LLP

(57) ABSTRACT

A forming mold for making ceramics having a pattern includes a first mold made of a water-permeable material and including a first press face, a second mold made of a water-permeable material and including a second press face, and a third mold made of a water non-permeable material and disposed between the first and second molds. The third mold has a third press face in contact with the first press face, and a patterned face opposite to the third press face and cooperating with the second press face to confine a forming space.

11 Claims, 4 Drawing Sheets

MOLD FOR MAKING CERAMICS

BACKGROUND OF THE INVENTION

1. Field of the Invention

This invention relates to a forming mold, more particularly to a forming mold for making ceramics having a pattern, such as an intaglio pattern.

2. Description of the Related Art

FIG. 1 illustrates a conventional forming mold 1 for making ceramics. The forming mold 1 includes an upper mold 11 and a lower mold 12 both made of gypsum. The upper mold 11 includes an upper forming portion 111 having an intaglio patterned face 113, and a passage 112 extending through the upper forming portion 111. The lower mold 12 includes a lower forming portion 121 having a top face cooperating with the intaglio patterned face 113 to confine a forming space 13.

To make a ceramic 10, a ceramic slurry is poured into the forming space 13 via the passage 112 either manually or by using a machine, after which the ceramic slurry is dried by a natural drying process or by a heating process. The formed ceramic 10 has an intaglio pattern 101 on an outer surface thereof.

However, the conventional forming mold 1 has the following drawbacks:

1. Whether the ceramic slurry is dried by a natural drying process or by a heating process, the gypsum will absorb the water content of the ceramic 10, so that during the forming process, the ceramic slurry is formed with bubbles. Some of the bubbles are formed on the intaglio patterned face 113. Hence, the detail in the intaglio pattern 101 on the outer surface of the formed ceramic 10 is adversely affected.

2. Protrusions of the intaglio patterned face 113 are hard and brittle, so that they are easily damaged. Such damage is difficult to repair. The presence of such damage also adversely affects the detail in the intaglio pattern 101 on the outer surface of the ceramic 10.

3. When the amount of the ceramic slurry poured into the forming space 13 is insufficient, additional amounts of the ceramic slurry are poured until a sufficient amount of the ceramic slurry is obtained. This results in complicated production of the ceramic 10.

SUMMARY OF THE INVENTION

Therefore, the object of the present invention is to provide a forming mold that is capable of overcoming the aforementioned drawbacks of the prior art.

According to this invention, a forming mold for making ceramic having a pattern comprises a first mold made of a water-permeable material and including a first press face, a second mold made of a water-permeable material and including a second press face, and a third mold made of a water non-permeable material and disposed between the first and second molds. The third mold has a third press face in contact with the first press face, and a patterned face opposite to the third press face and cooperating with the second press face to confine a forming space.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
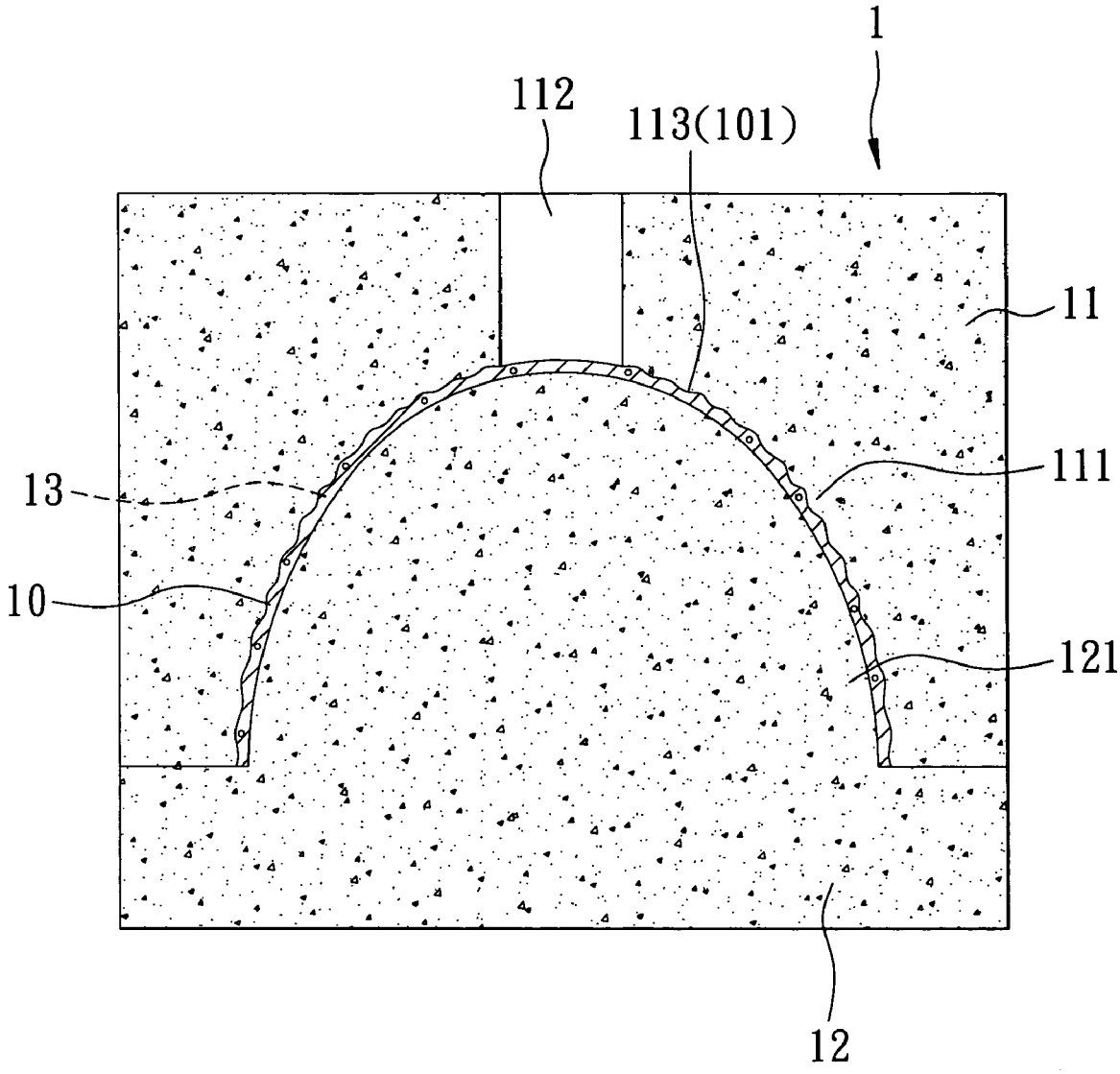
FIG. 1 PRIOR ART
FIG. 1 is a sectional view of a conventional forming mold in a state of use.
Figure 2:
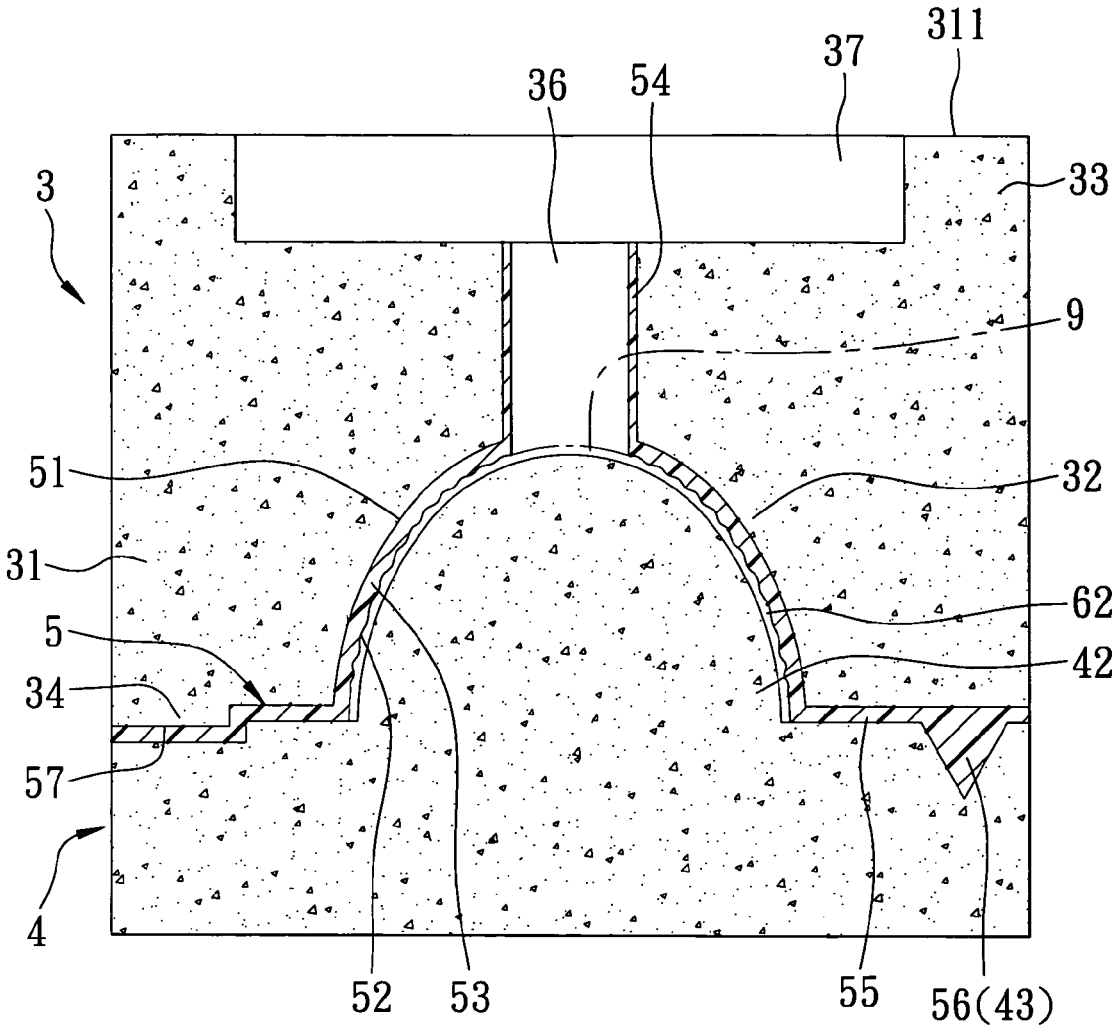
FIG. 2 is a sectional view of a forming mold according to the preferred embodiment of this invention.
Figure 3:
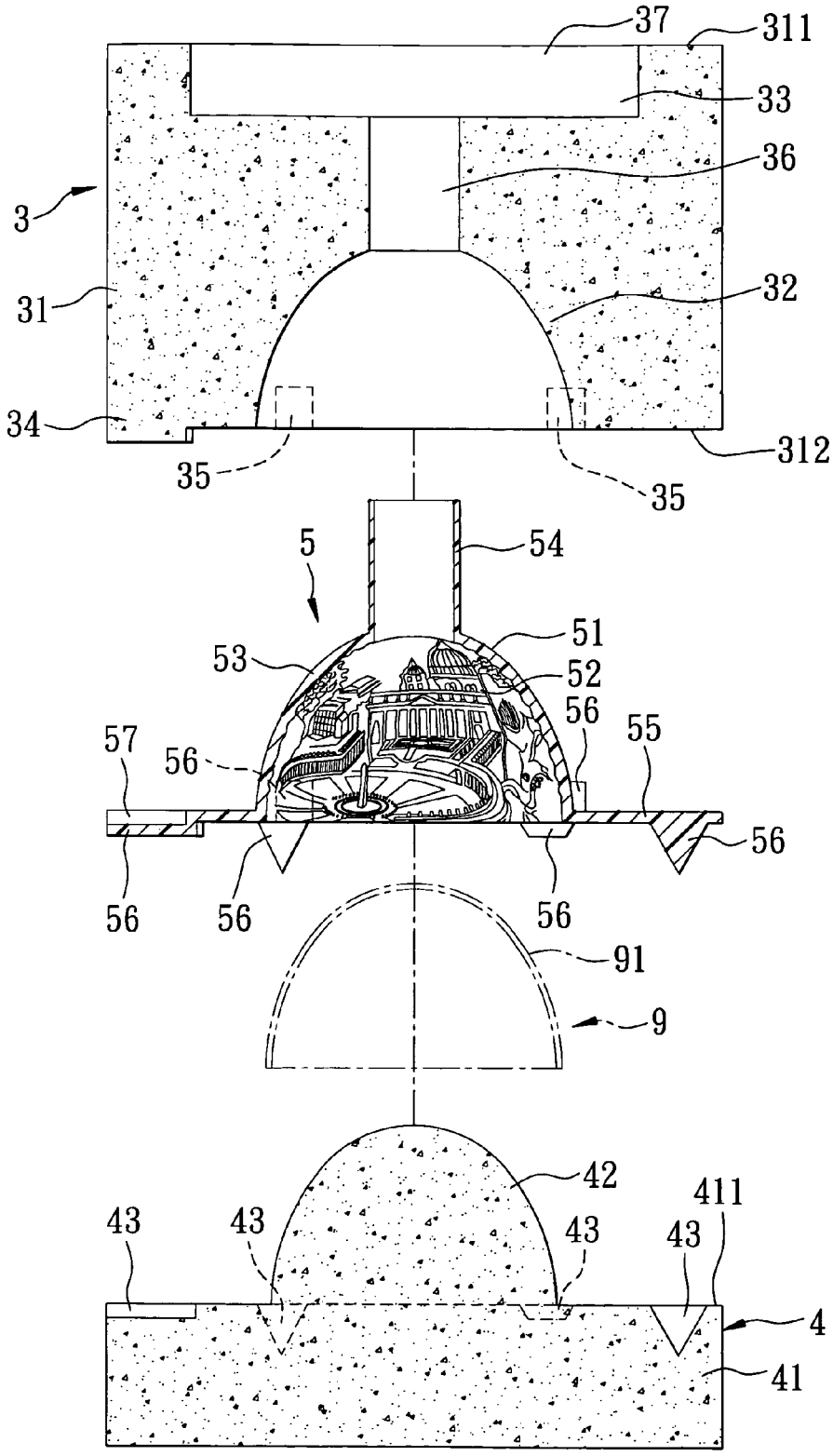
FIG. 3 is an exploded sectional view of the forming mold of the present invention.

Referring to FIGS. 2 and 3, a forming mold according to the preferred embodiment of the present invention is shown to comprise a first mold 3, a second mold 4, and a third mold 5.

The first mold 3 is made of a water-permeable material, and has a main body 31 including top and bottom end faces 311, 312, and a feed inlet 33. The bottom end face 312 is recessed to form a first press face 32 that is free of pattern, so that the first press face 32 is concaved. The feed inlet 33 includes a large diameter outer section 37 extending through the top end face 311 and adapted to receive a predetermined amount of a ceramic slurry, and a small diameter inner section 36 connected to the large diameter outer section 37 and extending through the first press face 32. The bottom end face 312 is formed with a plurality of first projections 34 and first indentations 35 surrounding the first press face 32.

The second mold 4 is made of a water-permeable material, and has a main body 41 including a second press face 42 that is convexed to complement the first press face 32, that is free of pattern, that is spaced apart from the first press face 32, and that projects from a top face of the second mold 4. A plurality of spaced-apart second indentations 43 are formed in a top end face 411 of the second mold 4, and surround the second press face 42.

The third mold 5 is made of a water non-permeable material, and is disposed between the first and second molds 3, 4. The third mold 5 includes a bowl-shaped portion 53, a tubular portion 54, and an annular flanged portion 55. The bowl-shaped portion 53 is disposed between the first and second press faces 32, 42, and has a third press face 51 in contact with the first press face 32, and a patterned face 52 opposite to the third press face 51. The patterned face 52 and the second press face 42 cooperatively confine a forming space 62. The tubular portion 54 extends upwardly from the bowl-shaped portion 53 into the small diameter inner section 36, and communicates with the large diameter outer section 37 and the forming space 62. The annular flanged portion 55 projects outwardly from a bottom end of the bowl-shaped portion 53, and has top and bottom faces formed with a plurality of second projections 56 and third indentations 57 (only one is shown). The second projections 56 are respectively engaged to the first and second indentations 35, 43. The first projections 34 are respectively engaged to the third indentations 57.

In this embodiment, each of the first and second molds 3, 4 is made of gypsum, and the third mold 5 is made of plastic, such as silicone.

Figure 4:
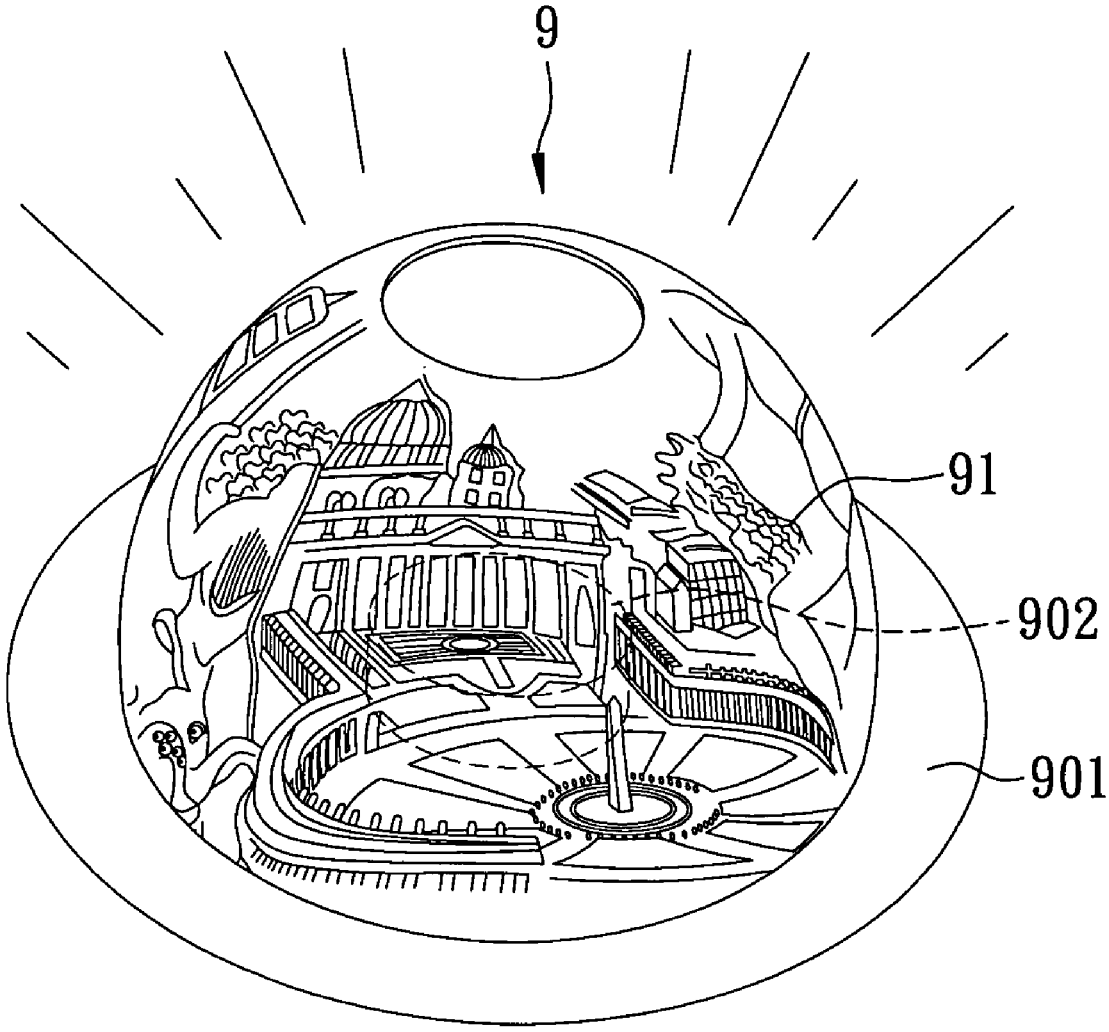
FIG. 4 is a perspective view of a ceramic made from the forming mold of the present invention.

To make a ceramic 9, a predetermined amount of a ceramic slurry is poured into the large diameter outer section 37 of the feed inlet 33, after which the forming mold of the present invention is placed in a vacuum-drawing device to draw air out of the forming mold. The ceramic slurry flows from the large diameter outer section 37 into the forming space 62 through the tubular portion 54 of the third mold 5, and is dried by a natural drying process or by a heating process, thereby forming the ceramic 9 having an outer surface with an intaglio pattern 91, as shown in FIG. 4. Water in the ceramic 9 is absorbed by the second press face 42. In this embodiment, the ceramic 9 is a cover of a candle holder. FIG. 4 illustrates the cover 9 covering a holder 901 having a candle 902 inside. Light created by the candle 902 penetrates through the cover 9.

The efficacy of the forming mold of the present invention can be summarized as follows:

1. The third mold 5 is made of a water non-permeable material, so that bubbles will not form on the intaglio pattern 91 of the outer surface of the ceramic 9. Hence, the detail in the intaglio pattern 91 on the outer surface of the ceramic 9 may be enhanced.

2. The third mold 5 has a soft texture, and is not easily damaged. Even if the third mold 5 has a defect, the third mold 5 may be replaced with a new one, so that it is not necessary to repair the first press face 32 of the first mold 3. Hence, the detail in the intaglio pattern 91 on the outer surface of the ceramic 9 may be similarly enhanced.

3. Since a predetermined amount of the ceramic slurry may be placed in the large diameter outer section 37 of the feed inlet 33 during production of the ceramic 9, when the forming mold of the present invention is placed in the vacuum-drawing device, it is not necessary to remove the forming mold from the vacuum-drawing device for refill of the ceramic slurry. A sufficient amount of the ceramic slurry is filled into the present forming mold once only. Hence, the making of the ceramic 9 using the present forming mold may be simplified.

It is worth mentioning that the intaglio pattern 91 may be formed in an inner surface of the ceramic 9 by making some modifications to the structures of the first to third molds 3, 4, 5. The aforementioned efficacy of the present invention can be similarly attained with such modified structures of the first to third molds 3, 4, 5. Ceramics made using the forming mold of the present invention, aside from being the cover 9 of a candle holder, may also be a bowl, a lampshade, etc.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A forming mold for making ceramics having a pattern, comprising:

a first mold made of a water-permeable material and including a bottom end face recessed to form a first press face, and a top end face opposite to said bottom end face;

a second mold made of a water-permeable material and including a second press face; and a third mold made of a water non-permeable material and disposed between said first and second molds, said third mold having a third press face in contact with said first press face, and a patterned face opposite to said third press face and cooperating with said second press face to confine a forming space;

wherein each of said first and second molds is made of gypsum, and said third mold is made of plastic;

wherein said first mold further includes a feed inlet communicating with said forming space, said feed inlet including a large diameter outer section extending through said top end face and adapted to receive a predetermined amount of a ceramic slurry, and a small diameter inner section connected to said large diameter outer section and extending through said first press face; and wherein said third mold includes a substantially bowl-shaped portion disposed between said first and second press faces and having said third press face and said patterned face, and a tubular portion that extends upwardly from said bowl-shaped portion into said small diameter inner section and that communicates with said forming space and said large diameter outer section.

2. The forming mold of claim 1, wherein said first press face is concaved, and said second press face is convexed to complement said first press face.

3. The forming mold of claim 1, wherein said first mold is disposed above said second mold.

4. The forming mold of claim 1, wherein said bottom end face of said first mold is provided with a plurality of first projections and first indentations surrounding said first press face, said second mold further including a plurality of second indentations provided in said top face thereof surrounding said second press face, said third mold further including an annular flanged portion that projects outwardly from a bottom end of said bowl-shaped portion and that has top and bottom faces provided with a plurality of projections respectively engaging said first and second indentations, and a plurality of third indentations, said first projections respectively engaging said third indentations.

5. The forming mold of claim 4, wherein each of said first and second press faces is free of pattern.

6. A forming mold for making ceramics having a pattern, comprising:

a first mold made of a water-permeable material and including a first end face that forms a first press face, and a second end face opposite to said first end face;

a second mold made of a water-permeable material and including a second press face; and a third mold made of a water non-permeable material and disposed between said first and second molds, the third mold having a third press face in contact with the first press face, and a patterned face opposite to the third press face and cooperating with the second press face to confine a forming space therebetween;

wherein the first mold further includes a feed inlet extending through the first press face and an opening through the second end face; and wherein the third mold includes a tubular portion that extends upwardly from the third press face into the feed inlet and that communicates with the forming space and the opening through the second end face.

7. The forming mold of claim 6, wherein the feed inlet includes a large diameter outer section extending through the second end face and a small diameter inner section connected to said large diameter outer section and extending through the first press face.

8. The forming mold of claim 7, wherein the large diameter outer section is adapted to receive a predetermined amount of ceramic slurry therein.

9. The forming mold of claim 8, wherein the first press face is recessed into the first end face, and wherein the third mold includes a substantially bowl-shaped portion disposed between the first and second press faces, the bowl-shaped portion having the third press face and the patterned face, and wherein the tubular portion extends upwardly from the bowl-shaped portion.

10. The forming mold of claim 9, wherein the first press face is concave, and the second press face is convex to complement the first press face.

11. The forming mold of claim 10, wherein each of the first and second molds is made of gypsum, and the third mold is made of plastic.

* * * * *